US011142884B1

(12) United States Patent
Ramun

(10) Patent No.: US 11,142,884 B1
(45) Date of Patent: Oct. 12, 2021

(54) EXCAVATOR SCRAPER ATTACHMENT

(71) Applicant: Michael D. Ramun, Youngstown, OH (US)

(72) Inventor: Michael D. Ramun, Youngstown, OH (US)

( * ) Notice: Subject to any disclaimer, the term of this patent is extended or adjusted under 35 U.S.C. 154(b) by 131 days.

(21) Appl. No.: 16/218,887

(22) Filed: Dec. 13, 2018

(51) Int. Cl.
*E02F 3/413* (2006.01)
*E02F 3/40* (2006.01)

(52) U.S. Cl.
CPC ..... *E02F 3/413* (2013.01); *E02F 3/404* (2013.01); *E02F 3/4135* (2013.01)

(58) Field of Classification Search
CPC ..... E02F 3/413; E02F 3/4135; E02F 3/404
USPC ..... 414/739, 740; 37/184, 188
See application file for complete search history.

(56) References Cited

U.S. PATENT DOCUMENTS 7,340 A * 5/1850 Davis ..... E02F 3/6463 37/467
3,523,380 A 8/1970 Bolyard et al.
3,802,731 A * 4/1974 La Bounty ..... B66C 3/04 294/197
3,807,589 A * 4/1974 Shovick ..... B66C 3/02 414/740
4,104,792 A * 8/1978 LaBounty ..... B26D 3/005 294/104
4,248,471 A * 2/1981 LaBounty ..... B66C 3/16 294/106
4,283,866 A * 8/1981 Ogawa ..... E02F 3/404 37/406
4,413,945 A * 11/1983 LaBounty ..... E02F 3/963 294/106
4,550,512 A 11/1985 Felstet
4,558,515 A * 12/1985 LaBounty ..... E02F 3/965 144/34.5
4,818,005 A * 4/1989 Purser ..... E02F 3/413 294/107
4,907,356 A * 3/1990 Labounty ..... E02F 3/404 294/68.23
5,062,227 A * 11/1991 De Gier et al. ..... E04G 23/08 37/406
5,253,449 A * 10/1993 Webb et al. ..... E02F 3/962 37/444
5,472,249 A 12/1995 Fiedler
5,553,408 A * 9/1996 Townsend ..... E02F 3/404 37/406
5,704,560 A 1/1998 Wimmer
6,640,471 B2 * 11/2003 Desrochers ..... E02F 3/404 37/406
7,207,610 B1 * 4/2007 Kauppila ..... B66C 1/585 294/106
7,818,901 B2 * 10/2010 Zeno et al. ..... E02F 3/3604 37/406
8,231,159 B2 * 7/2012 Raihala ..... E02F 3/4135 294/106

* cited by examiner

*Primary Examiner* — Thomas B Will
*Assistant Examiner* — Joel F. Mitchell
(74) *Attorney, Agent, or Firm* — Harpman & Harpman

(57) ABSTRACT

A scraper attachment for excavators for removing synthetic coatings on cylindrical surface object and the like. The scraper attachment has fixed and movable jaws with opposing scraper blades to grasp, hold and scrape an applied bonded coating from the object by oppositional fixed and movable action of the scraper blades in repetitive engagement.

1 Claim, 8 Drawing Sheets

EXCAVATOR SCRAPER ATTACHMENT

BACKGROUND OF THE INVENTION

1. Technical Field

This invention relates generally to grapple-like attachments for excavators for engaging, cutting and typically moving scrap material during processing.

2. Description of Prior Art

Prior art defines the problem of removing applied coatings from round surface objects, such as cylinder mill rollers which have been identified as requiring a variety of generally ineffective methods to achieve removal, such as burning and manual mechanical abrasion processes, for example.

Prior art patents disclose a variety of excavator and backhoe attachments, which can be seen in U.S. Pat. Nos. 3,523,380, 4,550,512, 5,472,249, 5,704,560 and U.K. Patent 2,243,358A.

In U.S. Pat. No. 3,523,380 a landscaping blade attachment is disclosed having a blade with a rounded bar on its material engagement edge.

U.S. Pat. No. 4,550,512 illustrates inner-changeable implements for an excavation bucket, wherein different multiple tangs and a landscape bar can be interchangeably positioned.

In U.S. Pat. No. 5,472,249, a grapple scoop attachment having a pair of opposing scoops for scooping up extraneous debris is illustrated and described.

U.S. Pat. No. 5,704,560 is directed to a concrete crusher with cutting shears showing a pair of hydraulic driven jaws with cutting jaw edge portions.

In UK Patent 2,243,358A, a multipurpose attachment can be seen with an opposing pair of tool carriers including grapples, buckets, pipe grabs and pallet tines.

It is apparent that none of the prior art references hereinbefore described address the critical issue of selectively engaging and removing applied bonded coatings, typically of synthetic resin or similar material from round cylindrical surfaces easily and efficiently.

SUMMARY OF THE INVENTION

The present invention is directed to a device that attaches to the hydraulic powered boom of an excavator for removing applied resilient coatings from round surface objects, such as industrial roller rolls. A pair of attached opposing scraper blades are adjustably aligned to engage and hold the object, then opposing scraping the object coating therefrom. The blades may be independently adjustable as to angle of attack with one holding in fixed engaged position while the opposing blade is moveable along the contoured surface of the object, scraping it clean in typical applications or both act as engageable scraping elements.

DETAILED DESCRIPTION OF THE INVENTION

Figure 1:
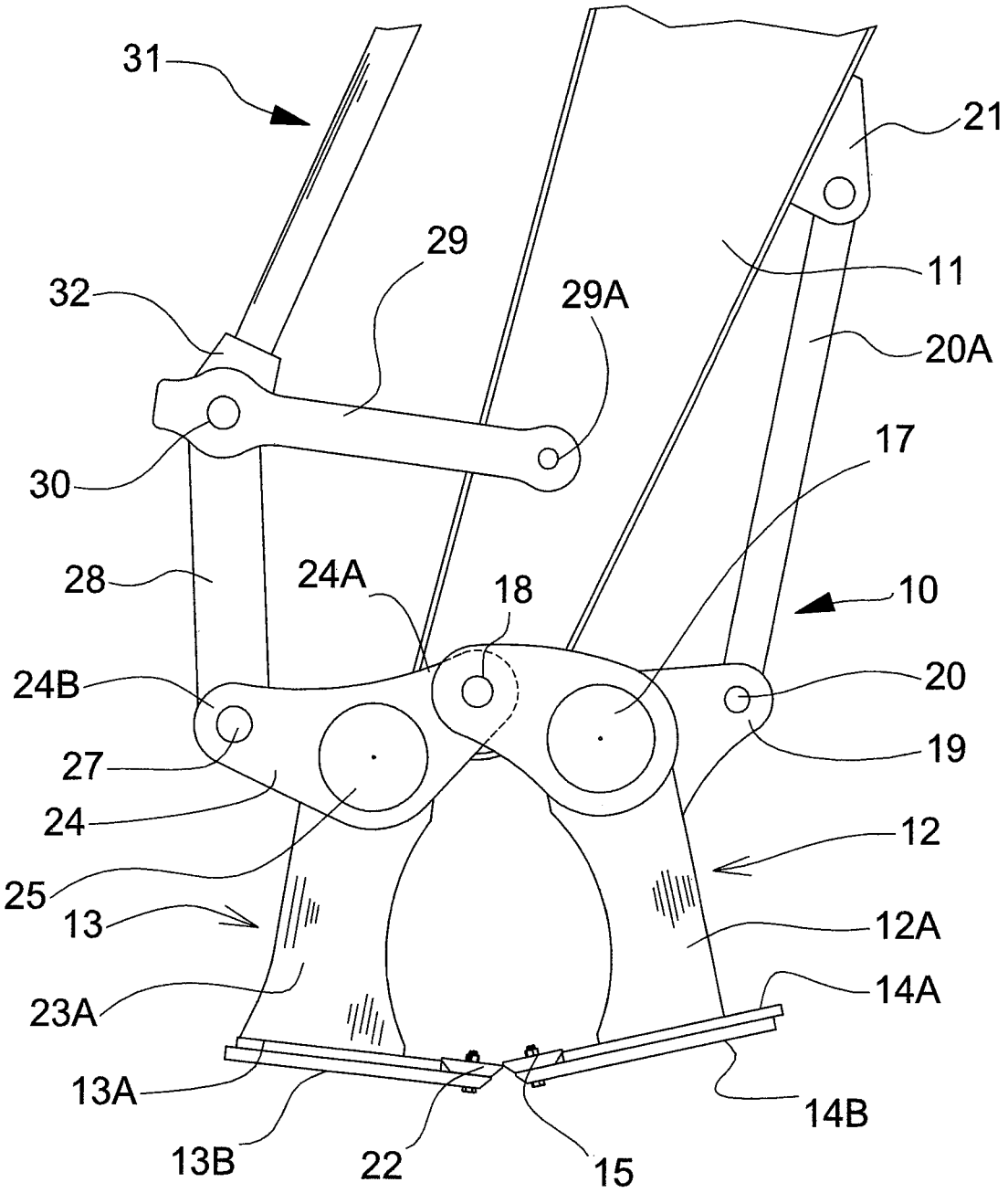
FIG. 1 is a side elevational view of the primary form of the scraper blade attachment of the invention on an excavator boom in closed opposing scraper blade position.
Figure 2:
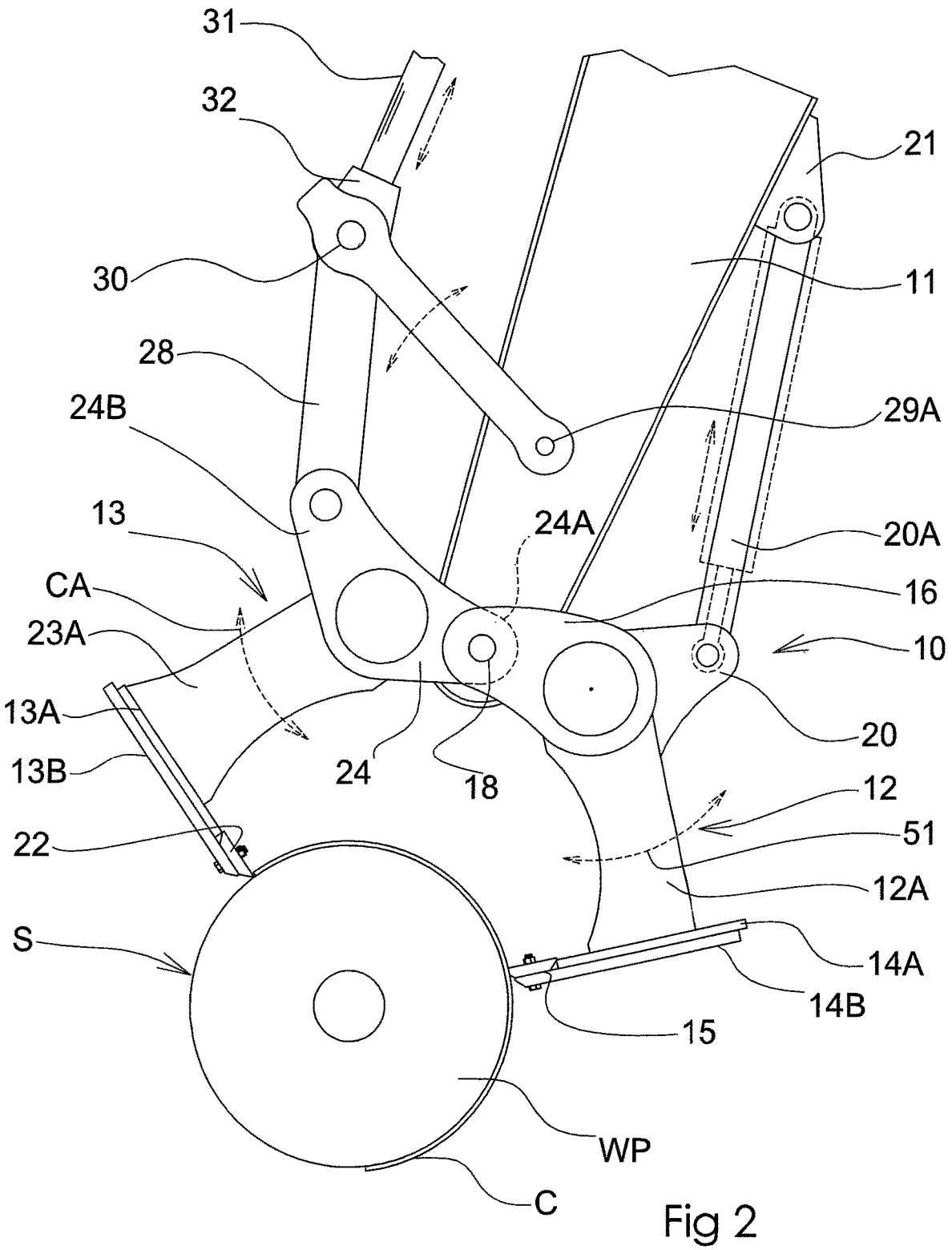
FIG. 2 is a side partial elevational view thereof shown in engagement with a roll representation.
Figure 3:
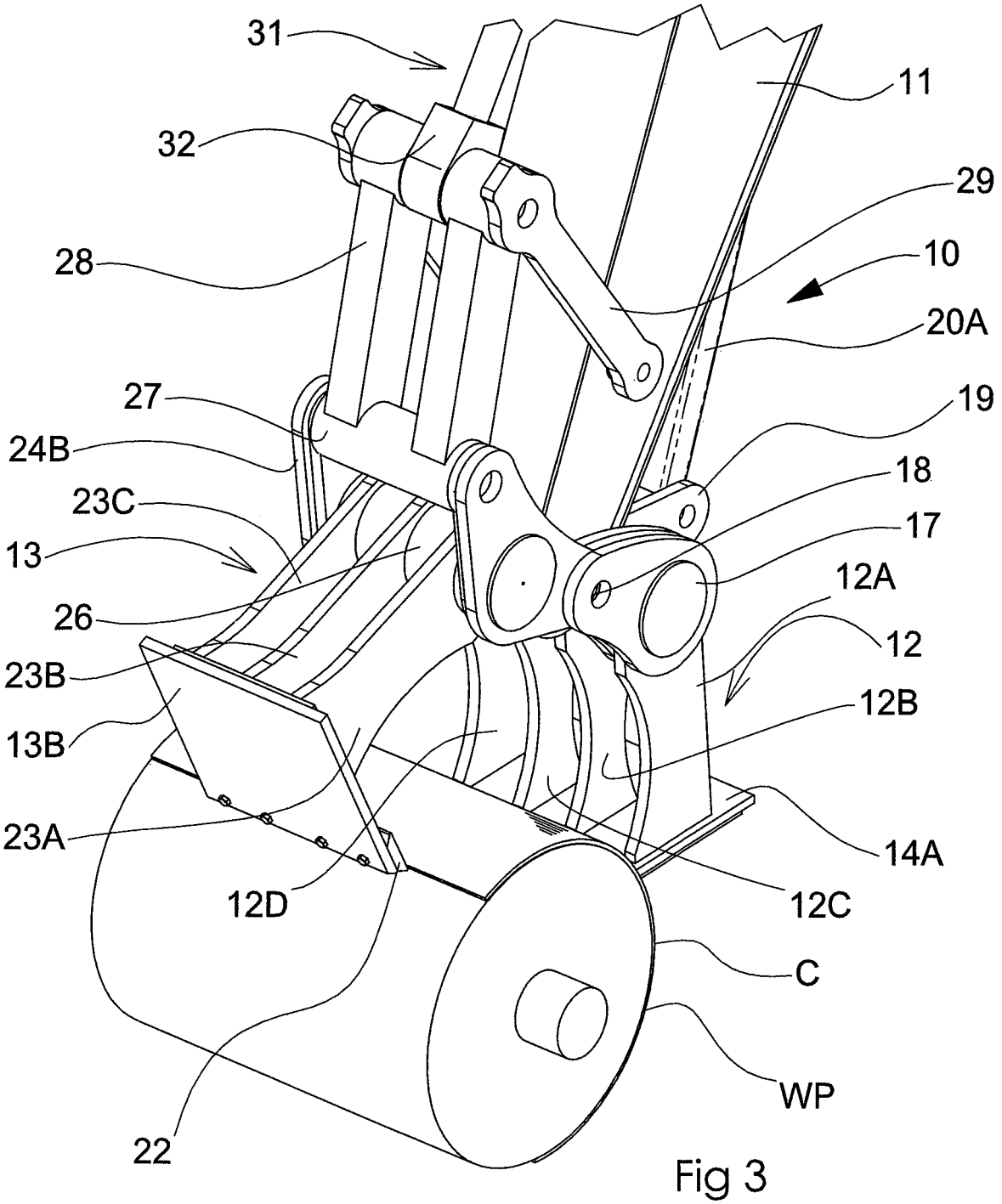
FIG. 3 is a perspective view thereof.
Figure 8:
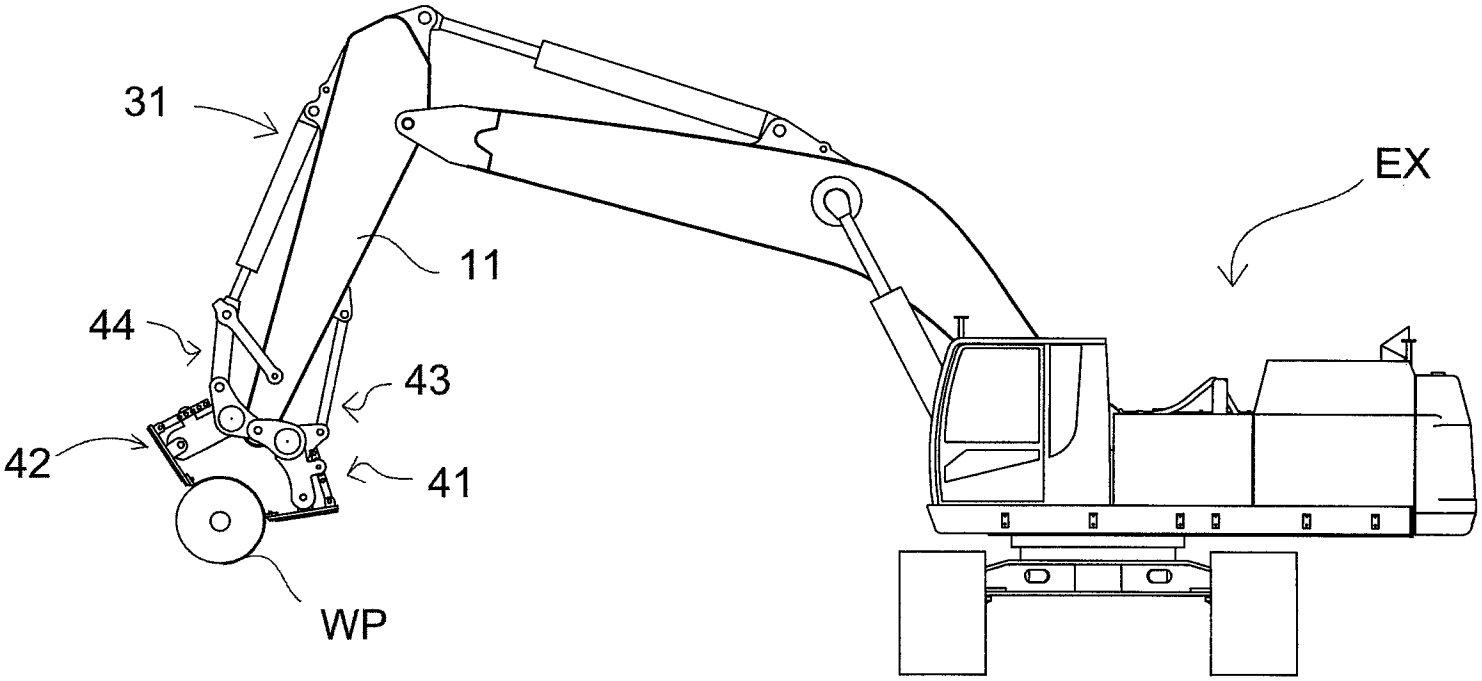
FIG. 8 is a graphic illustration of an excavator representation with a scraper blade attachment thereon.

Referring to FIGS. 1-3 of the drawings, a dual scraper blade attachment 10 of the invention can be seen mounted on the end of a hydraulic excavator boom 11 of an excavator EX as seen in FIG. 8 of the drawings. The scraper blade attachment 10 has a fixed upper jaw 12 and an opposing moveable lower jaw 13. The fixed upper jaw 12 has a plurality of aligned and apertured support plates 12A, 12B, 12C, 12D secured to and extending from a blade mounting plate 14A and scraper plate 14B having an interchangeable elongated blade inserts 15 removably positioned along its leading edge.

A pair of oppositely disposed multiple aligned aperture linking elements 16 extend from the ends of the respective oppositely disposed support elements 12A, 12D on a transverse bearing rod 17, best seen in FIG. 3 of the drawings. Correspondingly, the free apertured ends of the linkage element 16 are secured on the end of the boom 11 by a pivot pin 18 as will be well understood by those skilled in the art.

The support plates 12B, 12C have an apertured link portions 19 extending therefrom with a bearing rod 20 extending therethrough.

It will be seen that a pair of fixed arms 20A extend from the bearing rod 20 to corresponding apertured mounting tabs 21 on the body of the boom 11 in spaced relation to the pivot pin 18, providing static fixation points therebetween for the fixed upper jaw 12, as will be understood by those skilled in the art.

The movable lower jaw 13 has a corresponding blade mounting plate 13A with a scraper plate 13B and an elongated scraper blade insert 22. As described in the fixed jaw 12, the lower jaw 13 has multiple upstanding end apertured blade support plates 23A, 23B, 23C extending therefrom. A pair of spaced aligned apertured linking elements 24 are secured to the apertured free end of the plates 23A, 23C by a bearing pin 25 with spacers 26 therebetween, as best seen in again in FIG. 3 of the drawings.

The linkage elements 24 have apertured ends 24A which are pivotally secured to the boom 11 pivot pin 18 and therefore the linkage elements 16. A transverse support rod 27 extends between the linkage element ends 24B and has a pair of parallel spaced fixed arms 28 extending therefrom. It will be seen that a pair of link arms 29 are pivotally attached from the boom 11 at 29A and to their respective free ends on a pivot rod 30.

Figure 4:
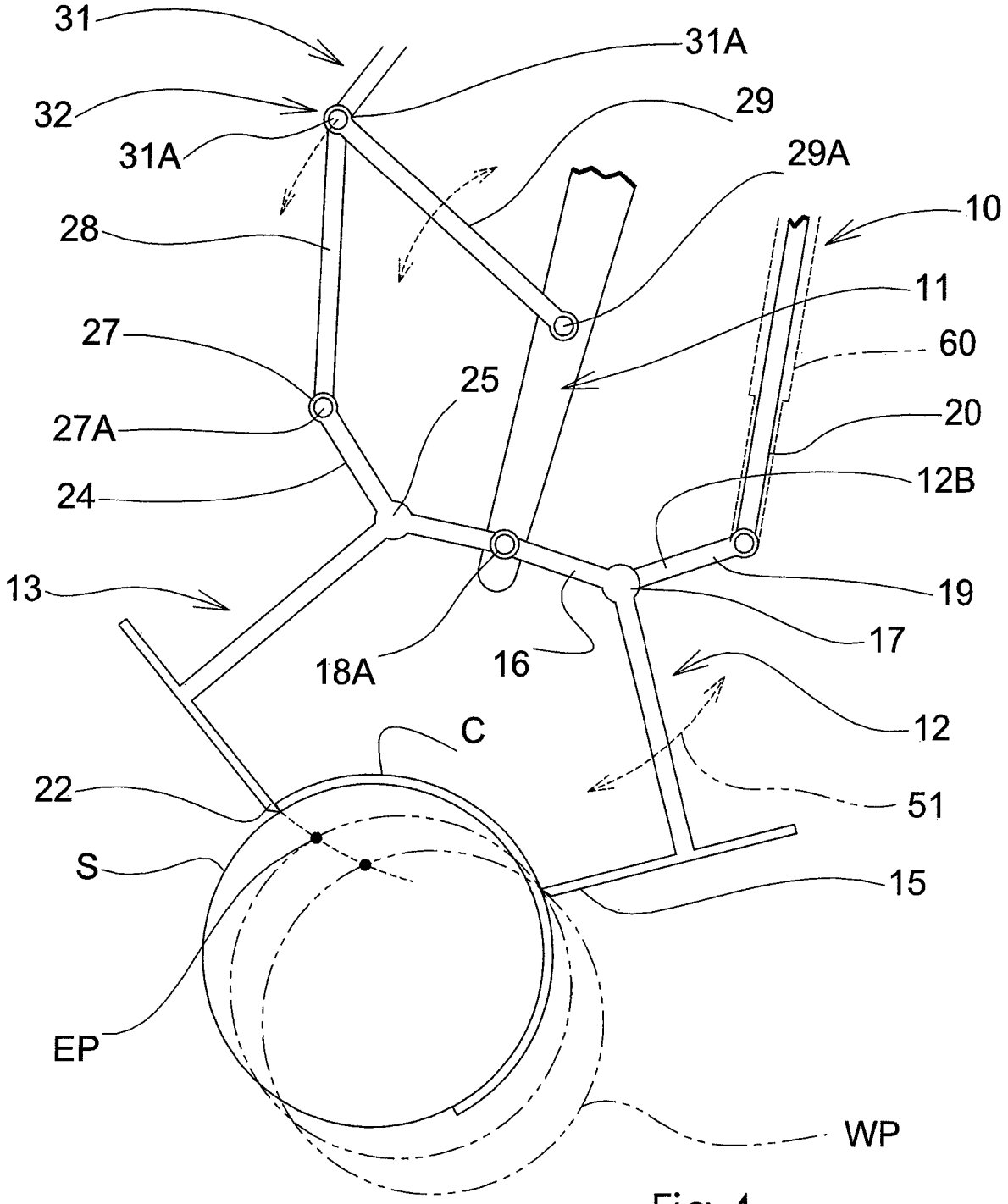
FIG. 4 is a graphic representation of the scraper blade attachment, indicating blade movement, linkage interconnection in forced positional travel as it engages a coated roll representation.

To activate the jaw 13, a power hydraulic piston and cylinder 31, best seen in FIG. 8 of the drawings, is pivotally secured to the boom 11 and has a piston rod end bearing fitting 32 between the fixed arm 28 and pivot arms 29 on the pivot rod 30, as will be understood by those skilled in the art, so as to impart reciprocal motion to the hereinbefore described linkage indicated by the broken line arrows in FIG. 4 of the drawings.

It will be evident from the above description that the lower jaw 13 is therefore movable in a progressive arc indicated by a broken line arrow CA in FIG. 2 of the drawings for engagement with a cylindrical work piece WP held by the fixed jaw 12, thereby following the curved surface S progressively so as to remove a bonded coating C therefrom.

In use, the opposing scraper blades 15, 22 work in unison to grasp, hold and scrape the outer coating C on the surface S of the work piece WP, as illustrated graphically in FIGS. 2 and 4 of the drawings. It will be noted that the angular inclination achieved between the fixed blade 15 and movable blade 22 is always greater than a relative ninety degrees to maintain contact with the surface S of the work piece WP as the movable lower jaw 13 progresses in its travel path, defined by its fixed pivot point at 18A on the boom 11 and the offset pivot point indicated at 27A from the piston rod end bearing 32 and associated linkage as herein before described.

This unique jaw engagement travel orientation achieves in sequential engagement with the round surface S of the work piece WP a progressive removal of the hereinbefore difficult to remove coating C therefrom.

Referring now to FIG. 4 of the drawings, a graphic representation of the effective compound movement of the lower jaw 13 is illustrated as determined by its fixed and pivot points as follows. The scraper blade insert 22 on the movable jaw 13 is in opposition to the fixed scraper blade insert 15 on the upper jaw 12 through its operational range, indicated by the multiple work piece WP in solid and broken lines on engagement points EP, illustrated progressively and repeatedly along the broken line of the travel path scraping the work piece. Accordingly, the fixed pivot points 18A and 29A on the boom 11 and the movable pivot points 31A, 27A enable the compound progressive travel path shown in broken lines the jaws 13 scraper blade 22 to be achieved.

It will also be seen that the fixed jaw 12 will act as a scraper element during progressive grasping of the work piece WP by the scraper blade attachment 10 of the invention in a dual unison fashion, achieving scraping of the coating C by both of the engaged blades while maintaining control and positional grasping of the work piece WP therebetween.

Figure 5:
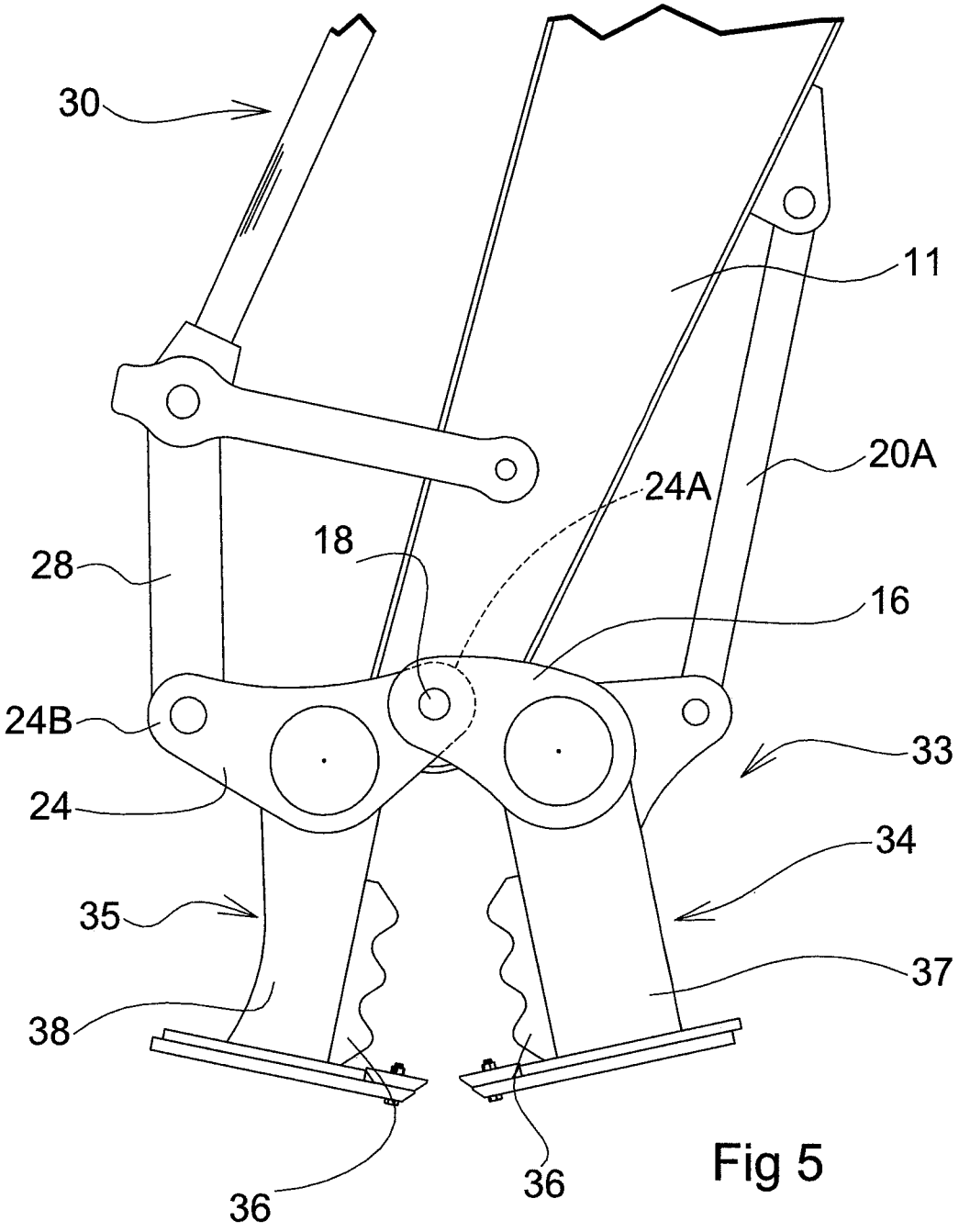
FIG. 5 is a partial side elevational view of alternate scraper blade attachment with material crushing plates positioned thereon.

Referring now to FIG. 5 of the drawings, an alternate form of the scraper blade attachment 10 can be seen at 33 having the fixed and movable jaws 34, 35 and associated linkage as the primary form of the scraper blade attachment 10, with the addition of opposing contoured surface engagement elements 36 on effacing edges of the corresponding scraper plate support elements 37, 38. This will form a dual use if needed as a "crusher" as well as a scraper blade attachment.

Figure 7:
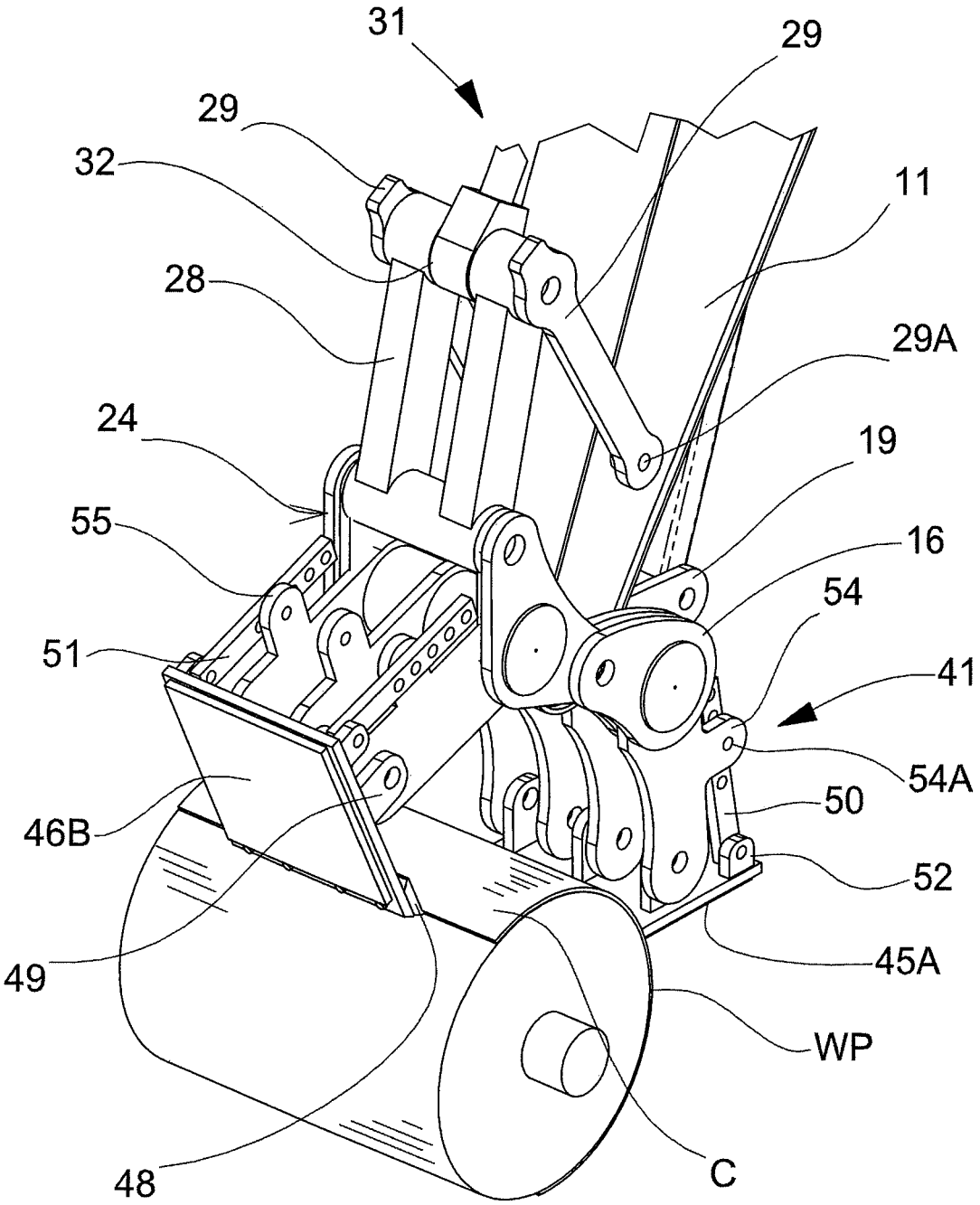
FIG. 7 is a perspective view thereof.

Referring to FIG. 7, of the drawings, an adjustable scraper blade attachment 40 can be seen having fixed and movable jaws 41, 42 which are attached to the excavator boom 11 by linkage assemblies 43, 44 identical to the hereinbefore described primary form of the invention illustrated in FIGS. 1, 2 and 3 of the drawings.

The alternate jaws 41, 42 have modified support elements 45, 46 wherein respective blade mounting plates 45A, 46A and attached scraper blades 45B, 46B with their blade inserts 47, 48 are pivotally attached thereto by multiple upstanding apertured pivot engagement tabs and pin assemblies 49. Pairs of angle adjustment arms 50, 51 for the respective jaws 41, 42 each have indexed spaced openings there along and extend from respective spaced pivot tab pairs 52, 53 on the mounting plates 45A, 46A to adjustable engagement apertured tab pairs 54, 55 by removable pins 54A, 55A extending from the jaw support elements in aligned orientation thereto. The angle adjustment arm pairs 50, 51 thereby allow for angular adjustment of the respective mounting plates 45A, 46A and their associated scraper blades 45B, 46B in relation to the respective jaws as seen in broken lines.

Figure 6:
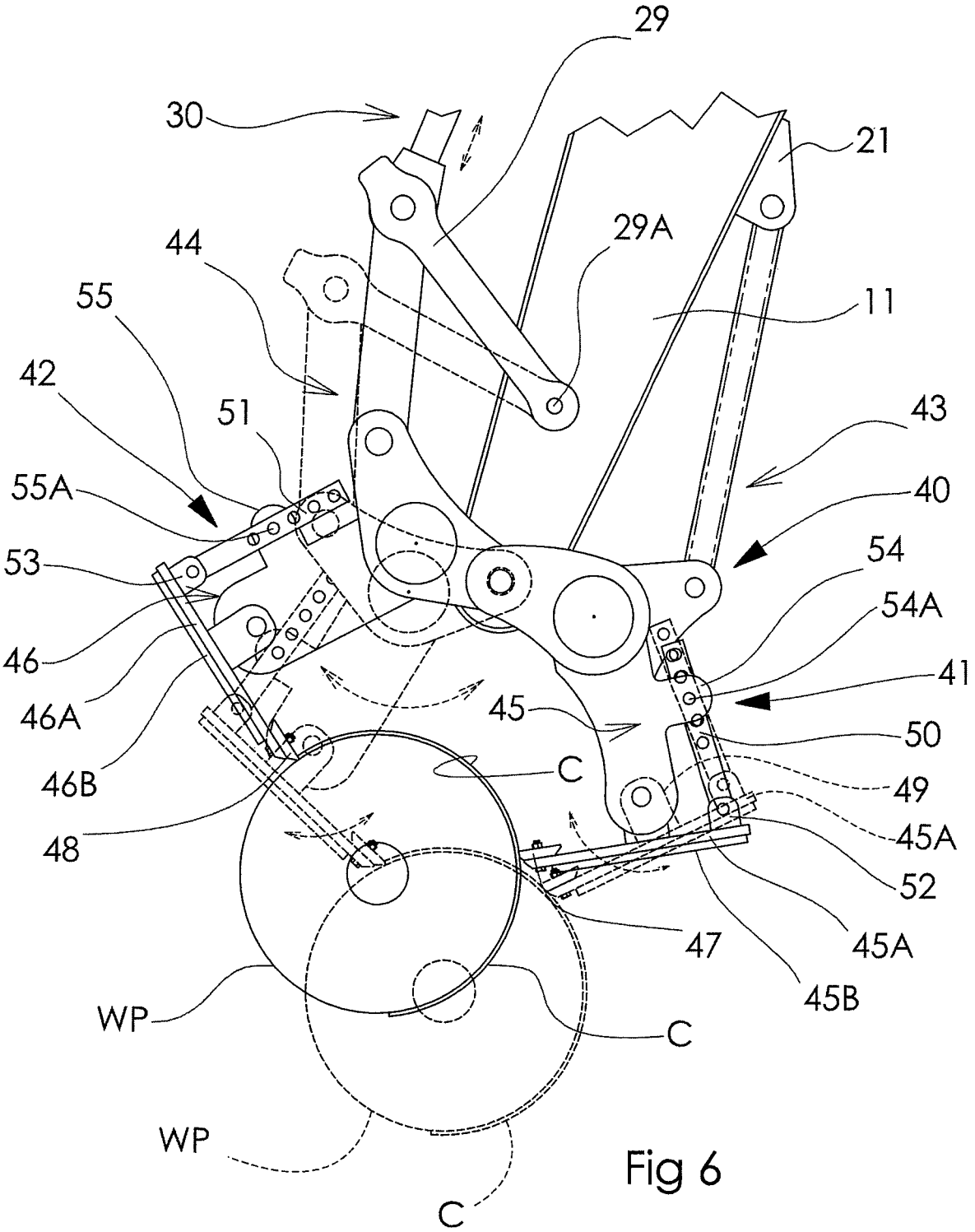
FIG. 6 is a partial side elevational view of an alternate form of the scraper blade attachment of the invention in open roll engagement position with adjustable angular scraper blade orientations.

The scraper blade adjustment provides for use on different sized work pieces WP as they are engaged, grasped and scraped clean of their coating C, as hereinbefore described shown in solid and broken lines in FIG. 6 of the drawings.

Referring back to FIG. 2 of the drawings as illustrated and so described a fixed jaw 12 may also be movable in some equipment alternate applications, as shown in broken lines.

An alternate second hydraulic piston and cylinder 60 can be positionally replaced, for illustrative purposes, the hereinbefore described fixed arms 20A, pivotally secured to said power boom.

A piston rod 61 from the cylinder assembly 60 is pivotally secured to said jaw 12 providing pivotal movement of said jaw on the boom pivot pin 18 illustrated travel path by broken arrow 51.

It will be evident from the above description that as such, a dual moveable jaw configuration 12, 13 will be achieved and will allow the excavator EX operator (not shown) the ability to manipulate the respective scraper blade equipped dual jaws 12,13 or 41,42, as illustrated independently and/or together, to grasp the work piece WP and thereby scraping the hereinbefore coating C therefrom by either independent or simultaneous jaw scraper blade inserts 15,22 engagement thereon.

It will thus be seen that a new and novel scraper blade attachment for an excavator has been illustrated and described and will be apparent to those skilled in the art that various changes and modifications may be made thereto without departing from the spirit of the invention.

Therefore, I claim:

1. A scraper plate attachment for a power boom of an excavator for removing coatings from cylinder surface objects comprises, an elongated fixed jaw and an elongated movable jaw extending from said power boom, respective scraper plates comprising a scraper plate on a free end of each of said respective jaws, each of said respective scraper plates extending continuously over and beyond the free ends of said respective jaws for integrated continuous surface contact with the cylinder surface objects, movable linkage elements extending from said elongated movable jaw to said power boom and a fixed linkage element extending from said elongated fixed jaw to said power boom, a hydraulic piston and cylinder unit on said power boom, a piston rod end bearing in communication with said movable linkage elements on said elongated movable jaw, said respective scraper plates extending from said free ends of said respective jaws in arcuate spaced oppositional alignment to one another, wherein said elongated fixed jaw and said elongated movable jaw comprise a plurality of spaced elongated parallel aligned apertured support plates secured to said fixed linkage element and said movable linkage elements respectively by bearing pins and spacers therebetween said support plates and extending at right angles from said respective scraper plates secured to respective free ends of said support plates, wherein said respective scraper plates are pivotally secured to said respective free ends of said support plates of said respective jaws by multiple upstanding aligned apertured pivot engagement tabs on said respective scraper plates and aligned apertures in said support plates by pivot pins therethrough, and wherein said respective scraper plates have respective upstanding pairs of engagement apertured tabs and adjustment arms pivotally secured to said respective engagement apertured tabs and to aligned engagement apertured tabs on said support plates for independent angular repositioning of said respective scraper plates to said free ends of said respective jaws.

* * * * *